US006174383B1

(12) United States Patent
Angel et al.

(10) Patent No.: US 6,174,383 B1
(45) Date of Patent: Jan. 16, 2001

(54) METHOD AT TREATMENT OF METALS

(75) Inventors: Charlotte Angel, Göteborg; Troy Berglind, Torslanda; Arne Frestad, Göteborg; Sven-Eric Lunner, Avesta; Anders Waleij, Borlänge, all of (SE)

(73) Assignee: EKA Chemicals AB, Bohus (SE)

( * ) Notice: Under 35 U.S.C. 154(b), the term of this patent shall be extended for 0 days.

(21) Appl. No.: 09/108,737

(22) Filed: Jul. 1, 1998

Related U.S. Application Data

(63) Continuation of application No. 08/757,446, filed on Nov. 27, 1996, now Pat. No. 5,810,939.

(30) Foreign Application Priority Data

Nov. 28, 1995 (SE) ..... 9504250

(51) Int. Cl.[7] ..... C23G 1/02; C23G 1/08

(52) U.S. Cl. ..... 134/41; 134/2; 134/3; 134/10

(58) Field of Search ..... 134/2, 3, 10, 41, 134/32

(56) References Cited

U.S. PATENT DOCUMENTS

| | | | |
|---|---|---|---|
| 3,622,478 | | 11/1971 | Beyer . |
| 3,962,005 | | 6/1976 | Lerner . |
| 4,747,907 | * | 5/1988 | Acocella et al. . |
| 4,938,838 | | 7/1990 | Dalin et al. . |
| 5,154,774 | | 10/1992 | Bousquet et al. . |
| 5,354,383 | | 10/1994 | Bianchi . |
| 5,518,131 | * | 5/1996 | Chen et al. . |

FOREIGN PATENT DOCUMENTS

| | | |
|---|---|---|
| 0 582 121 A1 | 2/1994 | (EP) . |
| 2000196 | 1/1979 | (GB) . |
| 50-133125 | 10/1975 | (JP) . |
| WO 95/35397 | 12/1995 | (WO) . |

OTHER PUBLICATIONS

"Nonpolluting and regeneratable rust–removing agent for iron and steel" (abstract) Zhu et al., (CN 1,054,102) Aug. 28, 1991, Chemical Abstracts, vol. 116, No. 22, Jun. 1, 1992 (116:219062u).

"Descaling Method for Steel or Stainless Steel", (abstract of Japanese Patent No. 55–138081, Oct. 28, 1980) Tsuyoshi et al., Patent Abstracts of Japan.

"High–speed Pickling Method for Low CR Steel", (abstract of Japanese Patent 63–216986, Sep. 9, 1988) Hideaki et al., Patent Abstracts of Japan.

"Pickling of Austenitic Stainless Steel", Ryozo et al., abstract of Japanese Kokai No. 75,133,125, Oct. 22, 1975, Chemical Abstracts, vol. 84 (1976) p. 256 (84:139369e).

* cited by examiner

*Primary Examiner*—Alexander Markoff
(74) *Attorney, Agent, or Firm*—David J. Serbin

(57) ABSTRACT

The invention relates to a method at pickling of steel in an acidic aqueous pickling solution containing $Fe^{3+}$ and $Fe^{2+}$, wherein the steel is contacted with pickling solution that continuously is brought to circulate through a conduit into which hydrogen peroxide is supplied to oxidize $Fe^{2+}$ to $Fe^{3+}$.

10 Claims, 1 Drawing Sheet

METHOD AT TREATMENT OF METALS

This application is a continuation of application Ser. No. 08/757,446 filed Nov. 27, 1996, now U.S. Pat. No. 5,810, 939.

BACKGROUND OF THE INVENTION

The present invention relates to a method for pickling of steel in an acidic aqueous pickling solution containing $Fe^{3+}$ and $Fe^{2+}$. The pickling capability of the bath is maintained by continuous supply of hydrogen peroxide.

In manufacturing of steel, particularly stainless steel, an oxide layer forms at the surface during the annealing, and this layer must be removed. This is normally done by pickling which means that the steel is treated in an acidic oxidizing pickling bath to effect some dissolution of metal under the oxide layer which then comes loose. For a ling time, pickling of stainless steel has often been performed in pickling baths based on nitric acid as an oxidizing agent which, however, has involved emissions of nitrous fumes and nitrates that are detrimental to the environment.

U.S. Pat. No. 4,938,838 discloses addition of hydrogen peroxide for oxidizing nitrite to nitrate in nitric acid based pickling baths. The emissions of nitrous fumes are significantly reduced but are not totally eliminated, and the emissions of nitrates are not reduced at all.

Pickling without nitric acid is disclosed in the U.S. Pat. Nos. 5,154,774 and 5,354,383 and in GB-A-2000196. These processes are based on the fact that $Fe^{3+}$ in the pickling bath acts as an oxidizing agent and is reduced to $Fe^{2+}$ at the same time as metallic iron in the steel is oxidized to $Fe^{2+}$. In order to maintain the oxidation potential in the pickling bath hydrogen peroxide is added to reoxidize $Fe^{2+}$ to $Fe^{3+}$. A disadvantage of these processes is that the cost for hydrogen peroxide is rather high since a great deal of it does not just react with $Fe^{2+}$ but also with other metal ions in the pickling bath, such as $Fe^{3+}$, and is then consumed to no use. It is also hard to achieve a sufficiently high pickling rate.

SUMMARY OF THE INVENTION

The present invention concerns a method for pickling steel, preferably stainless steel, with an acidic aqueous pickling solution containing $Fe^{3+}$ and $Fe^{2+}$. The steel is contacted with pickling solution that continuously circulates through a conduit into which hydrogen peroxide is supplied to oxidize $Fe^{2+}$ to $Fe^{3+}$.

The object of the present invention is to provide an efficient and environmentally friendly process for pickling steel with low consumption of hydrogen peroxide.

It has surprisingly been found that the consumption of hydrogen peroxide is significantly lower if, instead of being supplied directly to a bath, it is fed into a special circulation conduit. It is assumed that the reaction between hydrogen peroxide and $Fe^{2+}$ is considerably faster than the corresponding undesired reactions with other metal ions. By feeding the hydrogen peroxide in a circulation conduit, there is always $Fe^{2+}$ present to come in contact with the hydrogen peroxide, while it has been found that in a pickling bath, even with vigorous agitation, always may exist zones depleted of $Fe^{2+}$. In order to minimize the consumption of hydrogen peroxide it is preferably supplied in such an amount that the pickling solution the steel is contacted with is substantially free from hydrogen peroxide.

BRIEF DESCRIPTION OF THE DRAWING

For a fuller understanding of the invention, the following detailed description should be read in conjunction with the drawing, wherein.

DETAILED DESCRIPTION OF THE PREFERRED EMBODIMENTS

Figure 1:
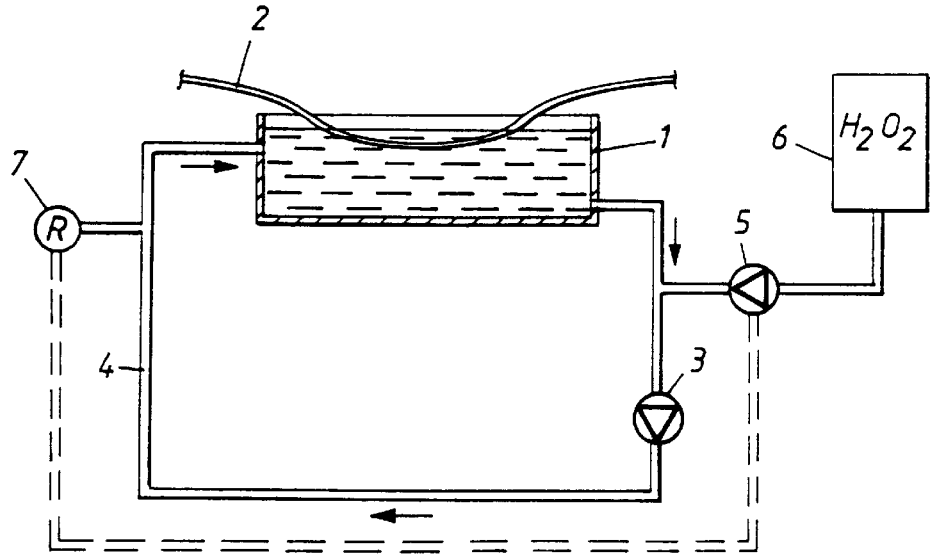
FIG. 1 is a schematic diagram of one embodiment of the invention in which a running strip of stainless steel is conducted continuously through a pickling solution.

The hydrogen peroxide is preferably supplied in such an amount that the content of $Fe^{2+}$ in the pickling solution the steel is contacted with becomes from about 0.2 to about 35 grams/liter, particularly from about 1 to about 20 grams/liter, and preferably so the content of $Fe^{3+}$ becomes from about 15 to about 80 grams/liter, particularly from about 25 to about 55 grams/liter. It is then preferred that the molar ratio $Fe^{2+}$:$Fe^{3+}$ becomes from about 0.01:1 to about 1:1, particularly from about 0.05:1 to about 0.25:1. Preferably, from about 0.3 to about 0.5 kg H2O2 (calculated as 100%) is added per kg $Fe^{2+}$ to be oxidized in the circulating pickling solution. The total content of iron ions, i.e. $Fe^{2+}$ and $Fe^{3+}$ in the pickling solution is suitable from about 15 to about 100 grams/liter, preferably from about 35 to about 65 grams/liter. The above contents of $Fe^{2+}$ and $Fe^{3+}$ refer to the solution in the circulation conduit before it comes into contact with the steel.

According to an advantageous embodiment, the supply of hydrogen peroxide is controlled on the basis of the redox potential in the pickling solution. The redox potential in the solution mainly depends on the ratio $Fe^{2+}$:$Fe^{3+}$, the acidity and the temperature. If the last two parameters are kept constant, the redox potential is a measure of the ratio $Fe^{2+}$:$Fe^{3+}$. Suitably the pickling solution is initially prepared with selected acidity and $Fe^{2+}$:$Fe^{3+}$ ratio and the redox potential then measured can be used as a set value for the regulation. Initially, as well as now and then during the pickling, the $Fe^{2+}$ content can be measured by permanganate titration while the total iron content and the acidity can be measured with commercially available instruments, such as Scanacon TMSA-20 which is based on measurement of acid concentration on ion-selective electrodes for fluoride and hydrogen ions and measurement of the total iron content based on density corrected for the concentration of acids and other metals. Preferably the redox potential is measured in the circulation conduit after hydrogen peroxide has been supplied and has reacted with $Fe^{2+}$. Depending on the design of the plant and the circulation rate of the pickling solution, the redox potential may also be measured in the bath or just before the hydrogen peroxide supply, preferably in combination with measurement also after the hydrogen peroxide supply. Preferably a partial flow of the circulating pickling solution is divided off for potential measurements, while measurements of acidity and iron content may be performed on samples taken out manually. Preferably, the redox potential is maintained from about 200 to about 600 mV, most preferably from about 300 to about 500 mV, measured between platinum and a silver/silver chloride electrode.

Suitably the pickling solution is brought to circulate with help from a pump, wherein the hydrogen peroxide preferably is supplied at the suction side of the pump which results in a very effective mixing. Suitably the pickling solution is circulated with a flow sufficient for maintaining a correct composition and redox potential in the entire volume, which in most cases means that it is circulated with a space velocity from about 0.5 to about 50 hours−1, preferably from about 5 to about 15 hours−1.

In one embodiment the steel is contacted with the pickling solution by being immersed in a bath, which may be performed continuously by transporting a band or the like through the bath, or batchwise by dipping objects such as wire coils or pipes in the bath and optionally vibrating the objects simultaneously. Objects such as wire coils may, for example, also be immersed into the bath at one end of the tub, be conveyed to the other end of the tub, and finally be lifted up again. The pickling solution in the bath is circulated through a conduit into which hydrogen peroxide is supplied and rapidly comes into contact with $Fe^{2+}$ so the solution has a suitable redox potential and suitable contents of $Fe^{2+}$ and $Fe^{3+}$ when it returns to the bath. If the hydrogen peroxide instead would have been added directly to the bath, a great deal of it might go to zones depleted of $Fe^{2+}$ and then being lost in side reactions. The steel can also be immersed in two or more baths after each others, preferably with individual circulation conduits and means for feeding the hydrogen peroxide, in which baths the pickling solution may have substantially the same or different compositions. It is also possible to perform one or more other treatment steps between the baths, for example washing or mechanical treatment such as brushing.

In another embodiment the steel is contacted with the pickling solution by spraying it onto the steel and then collecting it into a tank. Collected pickling solution is transferred from the tank to a circulation conduit into which hydrogen peroxide is supplied and rapidly comes in contact with $Fe^{2+}$. After completed oxidation from $Fe^{2+}$ to $Fe^{3+}$ the pickling solution is sprayed onto the steel. If the hydrogen peroxide instead would have been added directly to the tank a great deal of it would have been lost in side reactions since there always exist zones with low or non-existent concentrations of $Fe^{2+}$. Also in this embodiment the pickling may be performed continuously or batchwise in one, two or several steps in sequence, optionally with intermediate treatment steps.

It is also possible first so spray pickling solution onto the steel and then immerse the steel in a bath into which the sprayed pickling solution is collected.

The pickling solution suitably contains hydrofluoric acid, preferably from about 0.2 to about 5 mols/liter, measured as free fluoride, most preferably from about 1.5 to about 3.5 mols/liter. The hydrofluoric acid facilitates the pickling by complexing iron.

In order to reach sufficiently high acidity, the pickling solution preferably contains sulfuric acid, suitably from about 0.2 to about 5 mols/liter, preferably from about 1 to about 3 mols/liter.

Although normally not necessary, hydrogen peroxide with extra addition of stabilizers may be used, for example containing from about 0.5 to about 30 grams stabilizers per liter 35% hydrogen peroxide. Useful stabilizers comprises non-ionic surfactants such as ethoxylated alcohols, for example $C_{10-14}$-alcohol connected with 7 ethylene oxide and 1 propylene oxide.

Suitably the pickling solution is substantially free from nitric acid, problems with emissions of nitrous fumes or nitrates thus being avoided.

Suitably a temperature is maintained from about 30 to about 80° C., preferably from about 35 to about 60° C.

In order to avoid accumulation and possible precipitations, metals such as iron are preferably removed continuously from the pickling solution. This may, for example, be performed with acid retardation in commercially available equipment such as Scanacon™SAR 1100.

According to the invention, it has been found possible to combine high pickling rate with low hydrogen peroxide consumption. Further, it is not necessary to blow air or oxygen through the pickling solution as disclosed in the earlier mentioned U.S. Pat. Nos. 5,154,774 and 5,354,383 since the circulation conduit contributes both to effective mixing of the pickling solution and to efficient utilization of the hydrogen peroxide for oxidation of $Fe^{2+}$.

Figure 2:
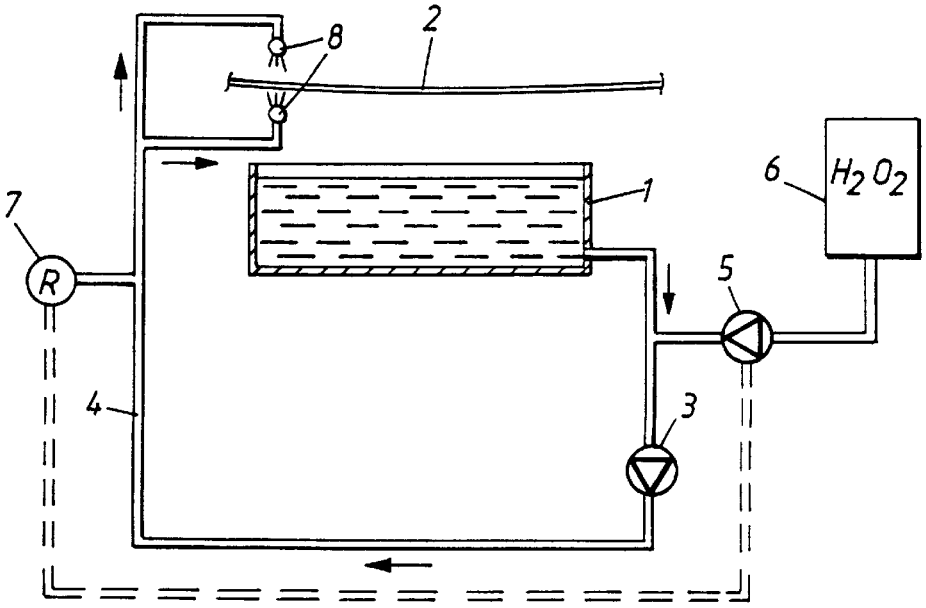
FIG. 2 is a schematic diagram of a second embodiment of the invention in which a steel strip is pickled via spraying of pickling solution.

The invention is now to be described in connection with the appended drawings, of which the FIGS. 1 and 2 schematically show two different embodiments.

FIG. 1 shows a tub 1 with a bath of pickling solution containing $Fe^{3+}$, $Fe^{2+}$, hydrofluoric acid, sulfuric acid and water, through which a running strip 2 of stainless steel is conducted continuously. The pickling solution is brought to circulate through a special conduit 4 with help from a pump 3. Hydrogen peroxide is supplied to the conduit 4 on the suction side of the pump 3 from a storage tank 6 with help from a feed pump 5. A partial flow from the circulation conduit 4 is led through an apparatus 7 for measurement of the redox potential and regulation of the feed pump 5 for hydrogen peroxide. It is possible also to measure the redox potential in the tub 1 or before the feed pump 5 and let the measured value control the set value for the redox potential to be maintained at the end of the circulation conduit 4. Normally also hydrofluoric acid and the sulfuric acid are supplied continuously in order to compensate for losses during the pickling.

FIG. 2 shows an embodiment in which a steel strip 2 is pickled without being immersed into the tub 1, instead pickling solution is sprayed onto the upper- and undersides of the strip through nozzles 8 and is collected into the tub 1. In other aspects the plant works as the one in FIG. 1. Thus, pickling solution is pumped around in a conduit 4 and is supplied with hydrogen peroxide at the suction side of the pump from a storage tank 6 with a feed pump 5 which is controlled with redox measurement in the apparatus 7. Although not shown in the figure, it is also possible to convey the steel strip vertically and spray the pickling solution on the sides.

The invention is also illustrated in the following examples. In the absence of other specification, all percentages refer to % by weight. All redox potentials are measured between platinum and a silver/silver chloride electrode.

EXAMPLE 1

Non neolytic pretreated plates of stainless steel 17-11-2 Ti with a thickness of 1.5 mm were pickled in a 20 liters bath consisting of an aqueous solution of 2.0 mols/liter $H_2SO_4$, 3.3 mols/liter HF, 10–11 grams/liter $Fe^{2+}$ and 69–70 grams/liter $Fe^{3+}$ for 7 minutes at a temperature of 60° C. and a redox potential of 380 mV. In experiment I the pickling solution was pumped around through a conduit so the space velocity was about 40 $hours^{-1}$. 35% hydrogen peroxide solution was fed in this conduit. In experiment II the pickling tub was provided with an agitator rotating with 60 r/min and 35% hydrogen peroxide solution was fed directly into the tub. The results appear from the table below in which the hydrogen peroxide consumption refer to 35% solution:

| Expr. | Pickled surface ($m^2$) | weight loss ($g/m^2$) | hydrogen peroxide consumption (ml/g) | hydrogen peroxide consumption ($ml/m^2$) |
|---|---|---|---|---|
| I | 0, 462 | 42, 3 | 1.2 | 51 |
| II | 0, 464 | 37, 0 | 1.9 | 69 |

The results show that the hydrogen peroxide consumption was decreased and the pickling rate increased when the hydrogen peroxide was fed in a circulation conduit.

EXAMPLE 2

In a full scale plant a 1270 mm wide and 0.6 mm thick band of neolytic pretreated stainless steel 17-12-2,5 L was pickled continuously with a speed of 35 meters/minute in two 12 $m^3$ tubs placed in sequence. In each one of the tubs the pickling solution was pumped around in a circulation conduit into which 35% hydrogen peroxide was fed, wherein the space velocity of the pickling solution in each tub was about 3 $hours^{-1}$. The total hydrogen peroxide consumption was about 30 ml 35% solution per $m^2$ pickled material. The first tub contained at steady state an aqueous solution of 2.69 mols/l HF, 1.82 mols/l $H_2SO_4$, 2.5 g/l $Fe^{2+}$ and 44.5 g/l $Fe^{3+}$, while the temperature was 60° C. and the redox potential was 439 mV. The second tub contained at steady state an aqueous solution of 2.58 mols/l HF, 1.74 mols/l $H_2SO_4$, 2.2 g/l $Fe^{2+}$ and 34.8 g/l $Fe^{3+}$, while the temperature was 61° C. and the redox potential was 452 mV. The pickling was approved by the regular controlled of the plant.

EXAMPLE 3

In a full scale plant a 1250 mm wide and 2.0 mm thick band of neolytic pretreated and grind brushed stainless steel 904 L was pickled continuously with a speed of 10 meters/minute in two 12 $m^3$ tubs placed in sequence. In each one of the tubs the pickling solution was pumped around in a circulation conduit into which 35% hydrogen peroxide was fed, wherein the space velocity of the pickling solution in each tub was about 3 $hours^{-1}$. The total hydrogen peroxide consumption was about 30 ml 35% solution per $m^2$ pickled material. The first tub contained at steady state an aqueous solution of 3.16 mols/l HF, 1.8 mols/l $H_2SO_4$, 1.7 g/l $Fe^{2+}$ and 45.3 g/l $Fe^{3+}$, while the temperature was 61° C. and the redox potential was 442 mV. The second tub contained at steady state an aqueous solution of 3.15 mols/l HF, 1.7 mols/l $H_2SO_4$, 2.6 g/l $Fe^{2+}$ and 3.94 g/l $Fe^{3+}$, while the temperature was 62° C. and the redox potential was 453 mV. The pickling was approved by the regular controller of the plant.

What is claimed is:

1. A method for pickling steel to remove an oxide layer from its surface comprising the steps of:

(a) immersing steel in a bath of acidic pickling solution containing $Fe^{2+}$ and $Fe^{3+}$ ions;

(b) pickling the steel by contact with the pickling solution in the bath;

(c) continuously circulating the pickling solution in the bath by passing the pickling solution through a conduit;

(d) oxidizing at least a portion of the $Fe^{2+}$ ions in the pickling solution to $Fe^{3+}$ ions by adding hydrogen peroxide to the pickling solution circulating in the conduit, the hydrogen peroxide being added in such an amount that the pickling solution which contacts the steel in the bath is substantially free of hydrogen peroxide.

2. A method as claimed in claim 1 wherein the pickling solution circulates through the conduit with a space velocity from about 0.5 to about 50 $hour^{-1}$.

3. A method as claimed in claim 1 wherein the pickling solution is circulated with a pump and the hydrogen peroxide is supplied at the suction side of said pump.

4. A method as claimed in claim 1 wherein the hydrogen peroxide is supplied in such an amount that the weight ratio $Fe^{2+}$:$Fe^{3+}$ is from about 0.01 to about 1:1 in the pickling solution the steel is contacted with.

5. A method as claimed in claim 1 wherein the hydrogen peroxide is supplied in such an amount that the content of $Fe^{2+}$ is from about 0.2 to about 35 grams/liter in the pickling solution the steel is contacted with.

6. A method as claimed in claim 1 wherein the pickling solution contains hydrofluoric acid.

7. A method as claimed in claim 1 wherein the pickling solution contains sulfuric acid.

8. A method as claimed in claim 1 wherein the pickling solution is substantially free from nitric acid.

9. A method as claimed in claim 1 wherein the sum of $Fe^{2+}$ and $Fe^{3+}$ ions in the pickling solution is from about 15 to about 100 grams per liter.

10. A method for pickling steel to remove an oxide layer from its surface comprising the steps of:

(a) immersing steel in a vat of acidic pickling solution containing $Fe^{2+}$ and $Fe^{3+}$ ions;

(b) pickling the steel by contact with the pickling solution in the bath, the pickling solution having a content of $Fe^{2+}$ of from about 0.2 to about 35 grams/liter;

(c) continuously circulating the pickling solution in the bath by passing the pickling solution through a conduit;

(d) oxidizing at least a portion of the $Fe^{2+}$ ions in the pickling solution to $Fe^{3+}$ ions by adding hydrogen peroxide to the pickling solution circulating in the conduit, the hydrogen peroxide being added in such an amount that the pickling solution which contacts the steel in the bath is substantially free of hydrogen peroxide.

* * * * *